US008845362B2

(12) United States Patent
Chikusa et al.

(10) Patent No.: US 8,845,362 B2
(45) Date of Patent: Sep. 30, 2014

(54) CONNECTOR HAVING A HOUSING WITH A LOCKING LANCE WITH REINFORCEMENT RIBS

(71) Applicant: Sumitomo Wiring System, Ltd., Yokkaichi (JP)

(72) Inventors: Takahiro Chikusa, Yokkaichi (JP); Shinji Iihoshi, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 16 days.

(21) Appl. No.: 13/795,447

(22) Filed: Mar. 12, 2013

(65) Prior Publication Data

US 2013/0260598 A1 Oct. 3, 2013

(30) Foreign Application Priority Data

Mar. 28, 2012 (JP) ..... 2012-073171

(51) Int. Cl.
*H01R 13/40* (2006.01)
*H01R 13/627* (2006.01)
*H01R 13/422* (2006.01)

(52) U.S. Cl.
CPC ..... *H01R 13/6275* (2013.01); *H01R 13/4223* (2013.01)
USPC ..... 439/595

(58) Field of Classification Search
CPC ..... H01R 13/113; H01R 13/642; H01R 13/4223; H01R 13/436
See application file for complete search history.

(56) References Cited

U.S. PATENT DOCUMENTS

| | | | | |
|---|---|---|---|---|
| 6,572,408 | B2 * | 6/2003 | Yamanashi et al. | 439/595 |
| 6,655,993 | B1 * | 12/2003 | Yamamoto | 439/595 |
| 6,655,994 | B2 * | 12/2003 | Yamamoto | 439/595 |
| 7,131,855 | B2 * | 11/2006 | Saitoh | 439/357 |
| 7,828,581 | B2 * | 11/2010 | Okayasu | 439/352 |
| 7,867,029 | B2 * | 1/2011 | Takahashi et al. | 439/595 |
| 8,210,873 | B2 * | 7/2012 | Chikusa | 439/595 |
| 2011/0143588 | A1 * | 6/2011 | Chikusa | 439/595 |

FOREIGN PATENT DOCUMENTS

JP 2009-104863 5/2009

* cited by examiner

*Primary Examiner* — Chandrika Prasad
(74) *Attorney, Agent, or Firm* — Gerald E. Hespos; Michael J. Porco; Matthew T. Hespos

(57) ABSTRACT

A connector includes a housing (10) made of synthetic resin and formed with a terminal accommodating chamber (11). A resiliently deformable locking lance (12) is cantilevered forward along an inner wall surface of the terminal accommodating chamber (11) and a locking projection (15) is formed on the locking lance (12). A terminal fitting (30) is inserted into the terminal accommodating chamber (11) from behind and has a locking hole (33) configured to engage the locking projection (15) when the terminal fitting (30) is inserted in the terminal accommodating chamber (11). Reinforcing ribs (20) are formed integrally on the locking lance (12) and project in a direction opposite to the terminal accommodating chamber (11) in a resilient deforming direction of the locking lance (12).

6 Claims, 11 Drawing Sheets

CONNECTOR HAVING A HOUSING WITH A LOCKING LANCE WITH REINFORCEMENT RIBS

BACKGROUND OF THE INVENTION

1. Field of the Invention

The present invention relates to a connector.

2. Description of the Related Art

JP 2009-104863 discloses a connector including a housing formed with a terminal accommodating chamber, a resiliently deformable locking lance cantilevered forward along an inner wall surface of the terminal accommodating chamber and a terminal fitting to be inserted into the terminal accommodating chamber from behind. The terminal fitting includes a locking hole and the locking lance includes a locking projection. The locking projection enters the locking hole when the terminal fitting is inserted in the terminal accommodating chamber and engages the edge of the locking hole to retain the terminal fitting so as not to move backward.

In the connector as described above, if the terminal fitting retained by the locking lance is pulled backward, the locking projection is inserted deeper into the locking hole and the locking lance is warped so that a front end thereof is displaced toward the terminal accommodating chamber. As the locking lance is warped more, the shear strength of the locking projection decreases and the reliability of a terminal fitting retaining function by the locking lance decreases.

The invention was completed based on the above situation and an object thereof is to prevent a reduction in the reliability of a retaining function by a locking lance.

SUMMARY OF THE INVENTION

The invention relates to a connector with a housing made of synthetic resin and formed with a terminal accommodating chamber. A locking lance is cantilevered forward along an inner wall surface of the terminal accommodating chamber and is resiliently deformable in directions toward and away from the terminal accommodating chamber. A locking projection is formed integrally on the locking lance and projects toward the terminal accommodating chamber. A terminal fitting can be inserted into the terminal accommodating chamber from behind and a locking hole is formed in the terminal fitting. The locking hole is configured to engage the locking projection to retain the terminal fitting that has been inserted in the terminal accommodating chamber. At least one reinforcing rib is formed integrally formed on the locking lance and projects in a direction opposite to the terminal accommodating chamber in a resilient deforming direction of the locking lance. The reinforcing ribs enhance the rigidity of the locking lance and prevent warping of the locking lance.

A formation area of the reinforcing rib in forward and backward directions preferably is continuous from the front end to the rear end of the locking lance. Thus, the locking lance is reinforced over the entire length of the locking lance and the warping of the locking lance is reliably prevented.

The at least one reinforcing rib preferably comprises two reinforcing ribs arranged along opposite side edges of the locking lance and are spaced apart in a width direction intersecting with the resilient deforming direction. Thus, the rigidity of the locking lance is higher as compared with the case where a reinforcing rib is provided only at one position in a widthwise central part.

The connector may further comprise two receiving portions formed in the housing and located at opposite sides of the locking lance in the width direction intersecting with the resilient deforming direction of the locking lance. Two restrictions may be integrally on opposite widthwise outer side surfaces of the locking lance and located at a side of the receiving ribs opposite the terminal accommodating chamber in the resilient deforming direction of the locking lance. The restrictions preferably are connected to the reinforcing ribs. If a backward pulling force acts on the terminal fitting, the restrictions engaged the receiving ribs, thereby restricting the warping of the locking lance. The restrictions are connected to the reinforcing ribs to provide high rigidity for preventing warping.

The housing preferably has a deformation space that permits the locking lance to deform resiliently away from the terminal accommodating chamber in the process of inserting the terminal fitting. The deformation space preferably is open on the front end of the housing. A detecting member preferably is provided for detecting an inserted state of the terminal fitting and can be inserted into the deformation space from front. The at least one reinforcing rib preferably comprises two reinforcing ribs projecting toward the deformation space and spaced apart in a width direction intersecting with the resilient deforming direction of the locking lance. A formation area of the reinforcing ribs in forward and backward directions is a range at least including a front end part of the locking lance. The reinforcing ribs function to guide the detecting member inserted into the deformation space from the front.

DETAILED DESCRIPTION OF THE PREFERRED EMBODIMENTS

A connector in accordance with the invention is described with reference to FIGS. 1 to 11. The connector includes a housing 10 made of synthetic resin and terminal fittings 30 to be inserted into the housing 10 from behind. In the following description, a width direction and a lateral direction are synonymous with each other. Further, a resilient deforming direction of a locking lance 12 and a vertical direction are synonymous with each other.

Figure 1:
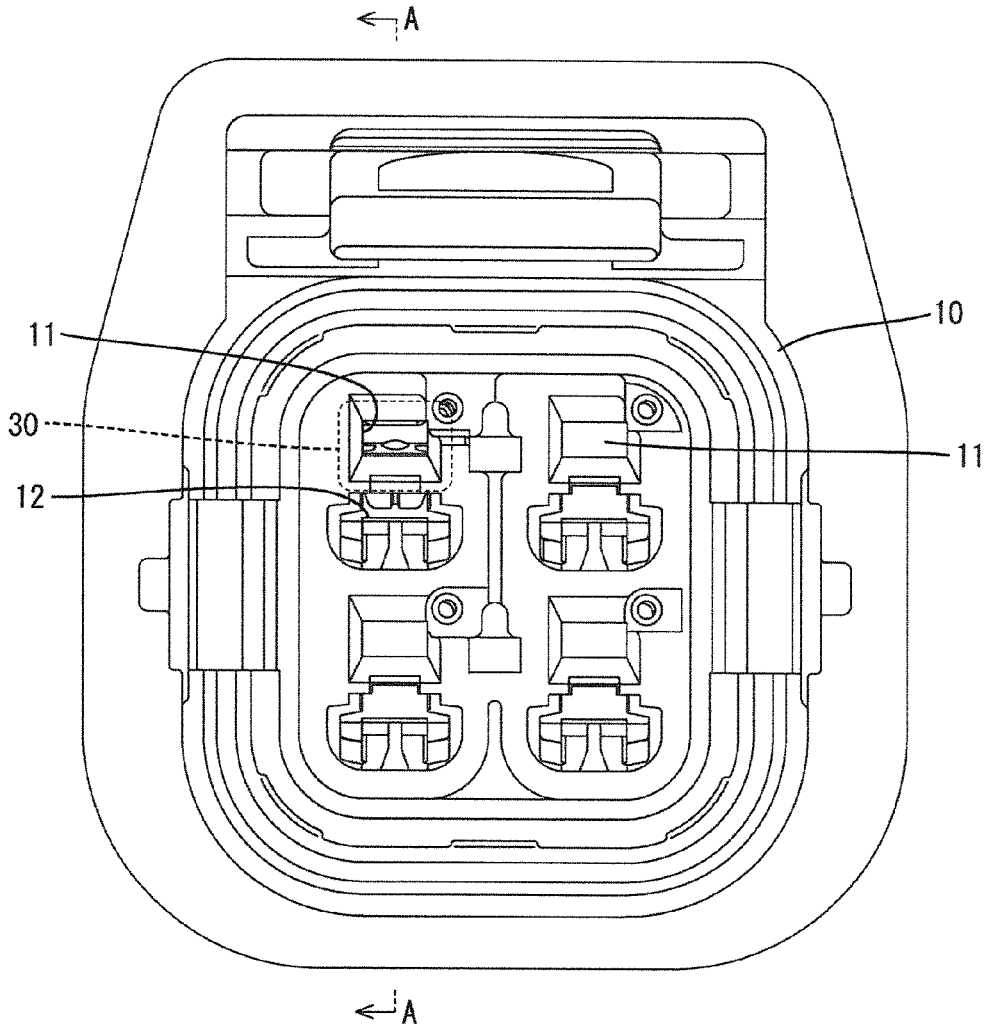
FIG. 1 is a front view of one embodiment.
Figure 2:
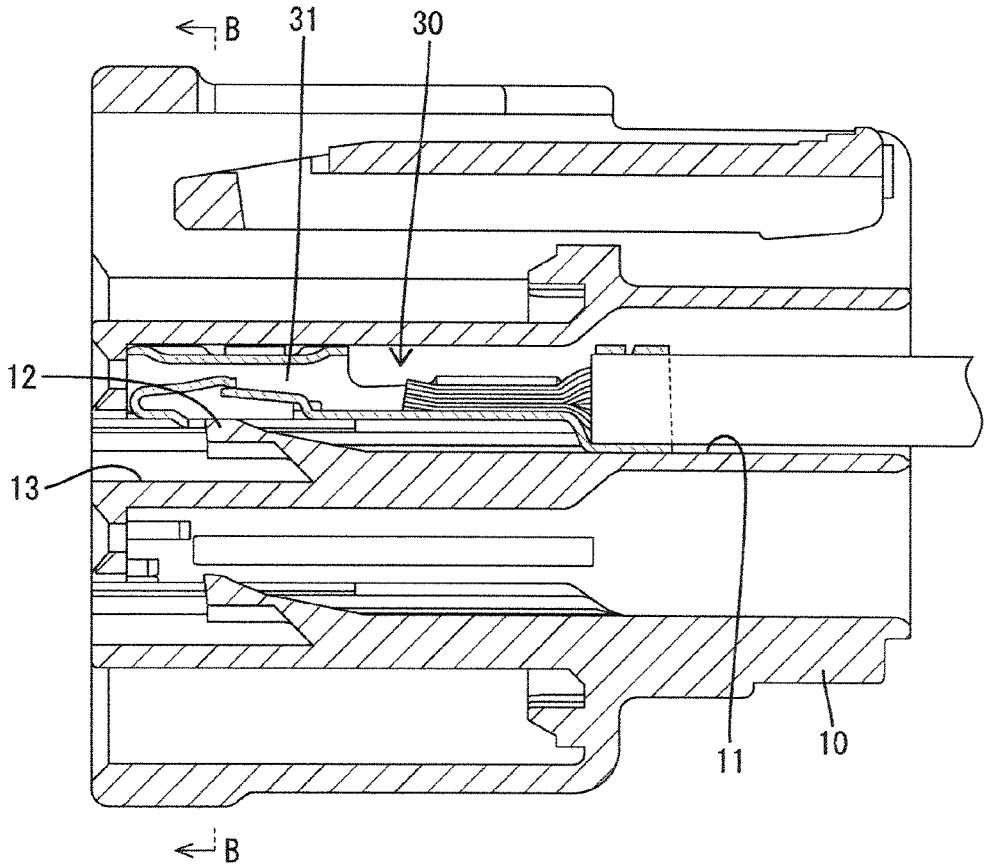
FIG. 2 is a section along A-A of FIG. 1.
Figure 3:
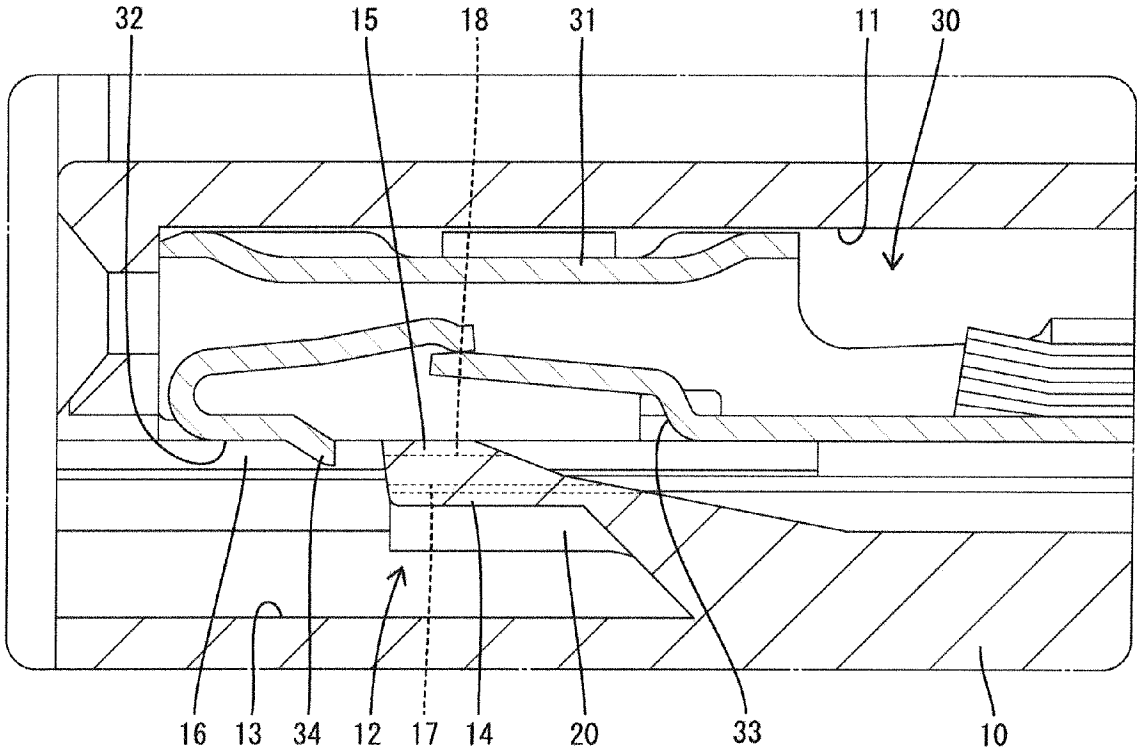
FIG. 3 is a partial enlarged view of FIG. 2.
Figure 4:
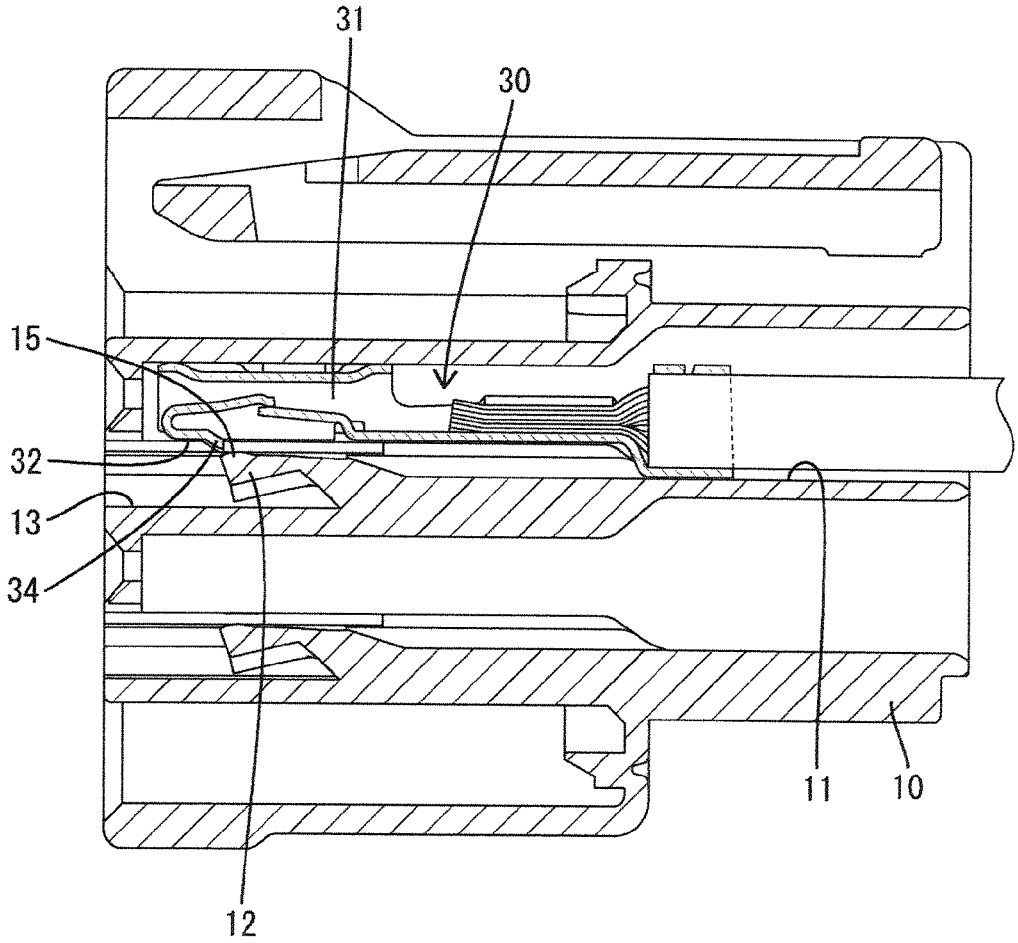
FIG. 4 is a side view in section showing a state where a terminal fitting is insufficiently inserted.
Figure 5:
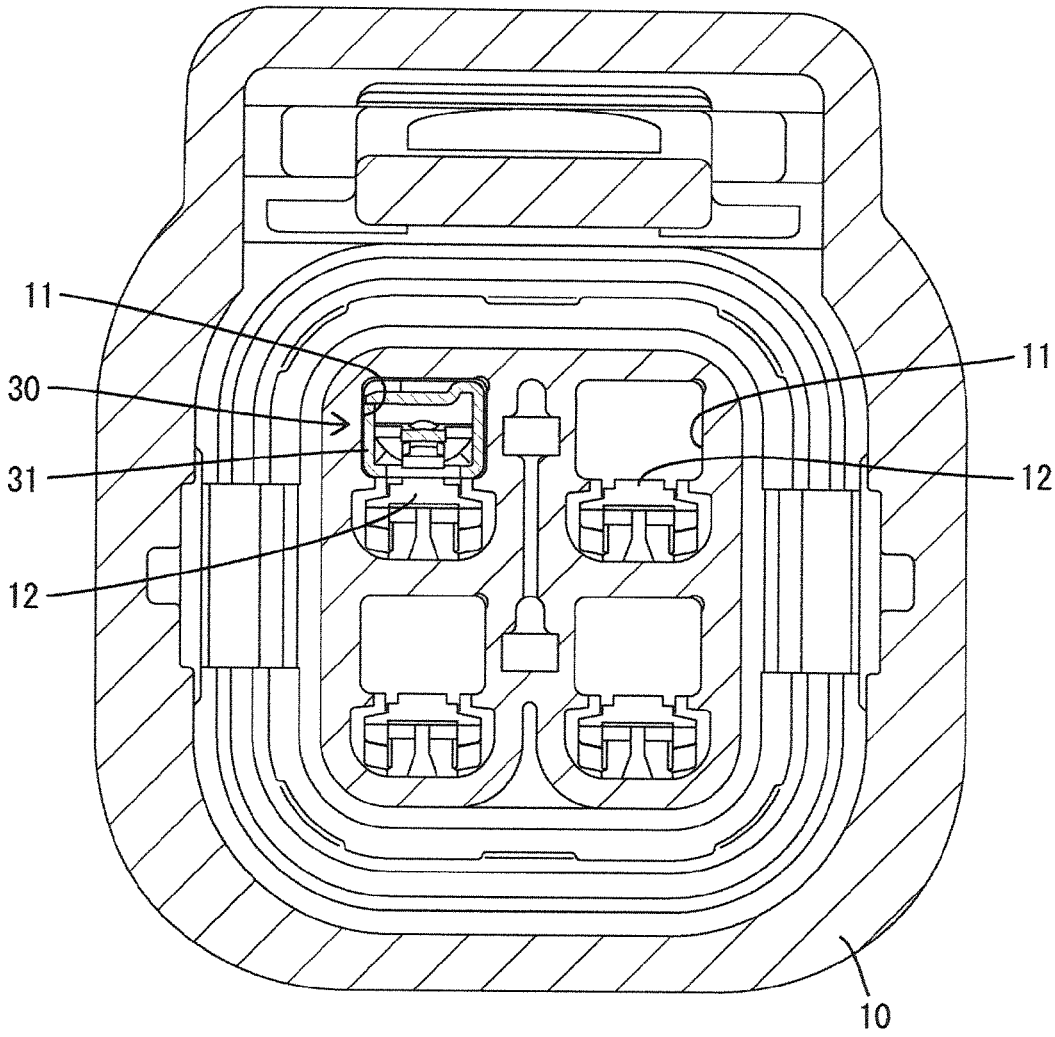
FIG. 5 is a section along B-B of FIG. 2.

As shown in FIGS. 1 to 5, terminal accommodating chambers 11 are formed in the housing 10 and the terminal fittings 30 are inserted into the terminal accommodating chambers 11 from behind (from the left in FIGS. 2 to 4). As shown in FIGS. 2 to 4, the terminal fitting 30 is a female terminal that is long and narrow in forward and backward directions. A rectangular tube 31 is formed at a front end part of the terminal fitting 30 and a rectangular locking hole 33 is formed in a widthwise central part of a bottom surface 32 of the rectangular tube 31. A locking protrusion 34 projects down at a position forward of the locking hole 33 projects downwardly. The width of the locking hole 33 is smaller than the width of the rectangular tube 31. Accordingly, receiving surfaces 35 are formed at areas of the bottom surface 32 of the rectangular tube 31 at opposite left and right sides of the locking hole 33 in the width direction (i.e. opposite left and right side edge parts of the bottom surface 32).

Locking lances 12 are formed unitarily with the housing 10 and cantilever forward along the lower wall surfaces of the terminal accommodating chambers 11. The locking lances 12 retain the terminal fittings 30 that have been inserted properly into the terminal accommodating chambers 11. Each locking lance 12 is resiliently deformable about a rear part that is connected to a lower wall of the terminal accommodating chamber 11 so that the locking lances 12 can swing vertically in directions intersecting an inserting direction of the terminal fitting 30 into the terminal accommodating chamber 11. A front end part of the locking lance 12 is displaced most when the locking lance 12 is resiliently deformed. Further, a deformation space 13 is formed below the terminal accommodating chamber 11 and permits the locking lance 12 to be deformed resiliently down in a direction away from the terminal accommodating chamber 11. The deformation space 13 is open at the front end surface of the housing 10.

Figure 6:
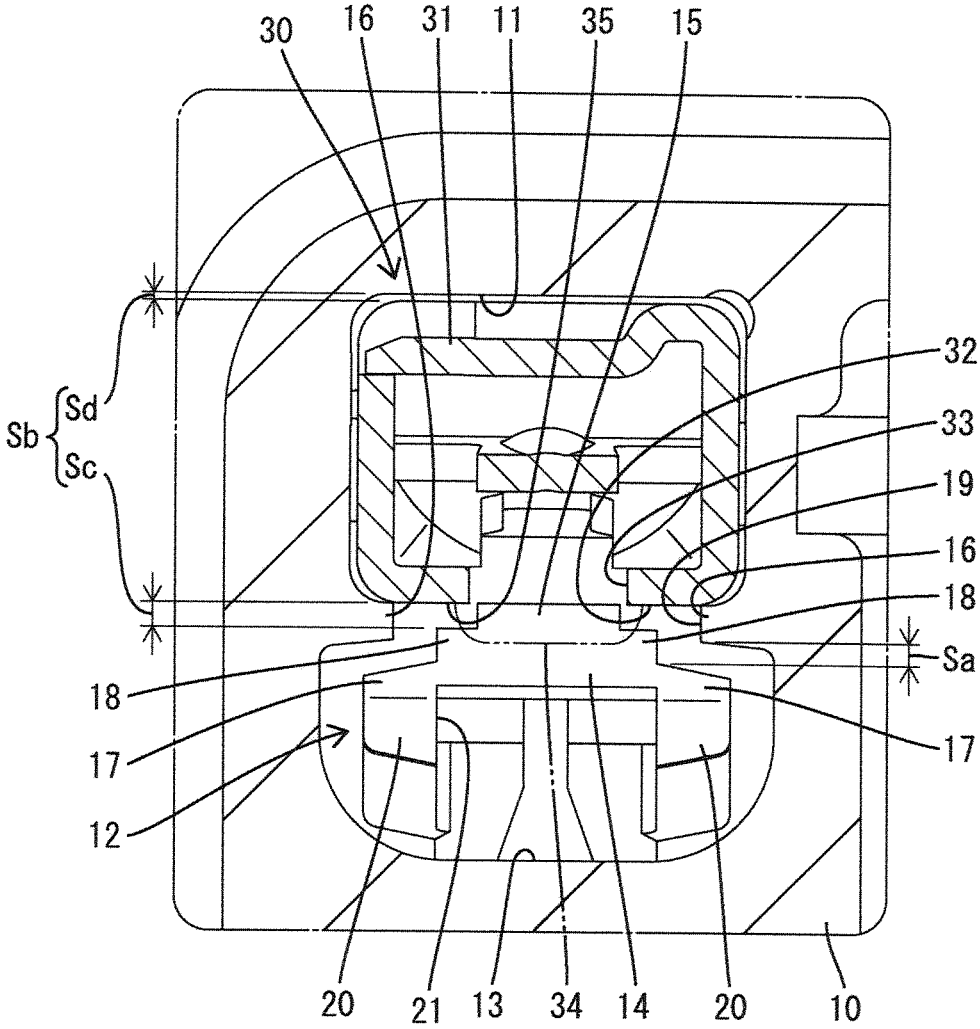
FIG. 6 is a front view in section showing a state where the terminal fitting is retained by a locking lance.

The locking lance 12 is described next, and a positional relationship in the following description is based on a state where the locking lance 12 is not deformed resiliently (free state). As shown in FIGS. 6 to 10, the locking lance 12 is bilaterally symmetrically shaped with respect to the width direction (i.e. lateral direction intersecting both the inserting direction of the terminal fitting 30 and the resilient deforming direction of the locking lance 12) and is arranged in the widthwise center of the terminal accommodating chamber 11. The locking lance 12 includes a main portion 14 and a locking projection 15. The main portion 14 is a plate that has a larger width than a vertical thickness dimension. As shown in FIG. 6, the upper surface (surface facing the terminal accommodating chamber 11) of the main portion 14 of the unbiased locking lance 12 is lower than the lower wall surface of the terminal accommodating chamber 11 in the vertical direction.

The locking projection 15 is unitary with the upper surface of the main portion 14 and projects up toward the terminal accommodating chamber 11. The locking projection 15 extends the front end of the main portion 14 to a substantially central part of the main portion 14 in forward and backward directions. Thus, the locking projection 15 is before a supporting point of resilient deformation of the locking lance 12 and the front end surfaces of the locking projection 15 and the main portion 14 are substantially flush. Further, the locking projection 15 is slightly narrower than the locking hole 33.

As shown in FIG. 3, the height of the locking projection 15 from the upper surface of the main portion 14 is highest at the front end of the locking projection 15. The upper surface of the locking projection 15 is inclined downwardly from the front end toward the rear end of the locking projection 15. The front end surface of the locking projection 15 is engageable with the locking protrusion 34 for locking the terminal fitting 30 from behind. This locking action retains the terminal fitting 30 even if pulled backward.

A shear surface extends from the engaged position of the locking projection 15 with the terminal fitting 30 rearward in a direction parallel to the lower surface of the terminal accommodating chamber 11 and the upper surface of the main portion 14, and hence parallel to inserting and withdrawing directions of the terminal fitting 30 into and from the terminal accommodating chamber 11. The retaining strength of the locking projection 15 that is engaged with the terminal fitting 30 is higher when the shear surface is larger. The area of the shear surface (i.e. shear strength) is largest when the rectangular tube 31 is in contact with the lower wall surface of the terminal accommodating chamber 11 and the locking lance 12 is in the free state.

The locking lance 12 may warp if the terminal fitting 30 is pulled back, and hence the front end of the locking lance may displace up due to the engagement of the locking projection 15 and the locking protrusion 34. The locking projection 15 inclines more backwardly as a degree of warping increases, and therefore the shear strength (area of the shear surface) decreases. Accordingly, the locking lance 12 is configured to suppress warping.

As shown in FIGS. 6 to 9, two bilaterally symmetric receiving portions 16 are formed in the housing 10 to suppress warping of the locking lance 12. The locking lance 12 is formed with two first restrictions 17, two second restrictions 18 and two reinforcements 20. Further, the upper surface of the terminal accommodating chamber 11, the rectangular tube 31 of the terminal fitting 30 and the left and right receiving surfaces 35 also function as the warping suppressing means.

The first restrictions 17 define ribs that project out in the width direction at opposite left and right outer side surfaces of the main portion 14. The first restrictions 17 are formed on a lower end part of the main portion 14 in the vertical direction. A formation area of the first restrictions 17 in forward and backward directions extends over the entire length of the main portion 14 of the locking lance 12 from the front end to the rear end. Upper surfaces of the first restrictions 17 are inclined down toward widthwise outer sides from the main portion 14.

On the other hand, the housing 10 is formed with the two receiving portions 16. A communication space 19 is formed in an area of the lower wall of the terminal accommodating chamber 11 corresponding to the main portion 14 in the width direction and allows communication between the terminal accommodating chamber 11 and the deformation space 13. Rib-shaped receiving portions 16 are formed at opposite left and right inner wall surfaces of the lower part of terminal accommodating chamber 11 and project in toward the communication space 19.

A formation area of the receiving ribs 16 in forward and backward directions corresponds to at least the front part of the locking lance 12 and the front ends of the receiving ribs 16 are located before the front end of the locking lance 12. Further, the receiving ribs 16 project inwardly in the width direction sufficiently to overlap outer edge parts of the first restrictions 17. The lower surfaces of the receiving ribs 16 incline down toward widthwise outer sides similar to the upper surfaces of the first restrictions 17. The upper surfaces of the receiving ribs 16 face the terminal accommodating chamber 11 and the bottom surface 32 of the terminal fitting 30 can contact with the upper surfaces of the receiving ribs 16. The first restrictions 17 are located below the receiving portions 16. In other words, in the resilient deforming direction, the first restrictions 17 are on a part of the locking lance 12 in the deformation space 13 and at a side of the receiving ribs 16 opposite the terminal accommodating chamber 11.

The locking projection 15 of the locking lance 12 is narrower than the main portion 14. Thus, second restrictions 18 are defined on opposite side edges of the main portion 14 and at the left and right sides of the locking projection 15. A vertical dimension of the second restrictions 18 is equal to the vertical dimension of the main portion 14 and is larger than the vertical dimensions of the first restrictions 17. Further, the front end part of the locking lance 12 is widest at a lower part (formation area of the first restrictions 17) and narrowest at an upper end part (locking projection 15). That is, the opposite left and right side surfaces of the locking lance 12 are stepped because of the first restrictions 17, the second restrictions 18 and the locking projection 15.

As shown in FIG. 6, the upper surfaces of the second restrictions 18 face the terminal accommodating chamber 11 and are located below the upper surfaces of the receiving ribs 16. Further, the upper surfaces of the second restrictions 18 are spaced below the receiving surfaces 35 by a predetermined first clearance Sc when the receiving surfaces 35 of the terminal fitting 30 are placed on the lower surface of the terminal accommodating chamber 11. Similarly, a predetermined second clearance Sd is formed between the upper surface of the rectangular tube 31 of the terminal fitting 30 and the upper wall surface of the terminal accommodating chamber 11 when the receiving surfaces 35 are in contact with the lower surface of the terminal accommodating chamber 11. The second clearance Sd ensures smooth insertion and withdrawal of the terminal fitting 30 into and from the terminal accommodating chamber 11. A second gap Sb is the sum of the first and second clearances Sc and Sd and is larger than a first gap, which is a shortest distance between the upper surfaces of the first restrictions 17 and the lower surfaces of the receiving ribs 16.

Figure 9:
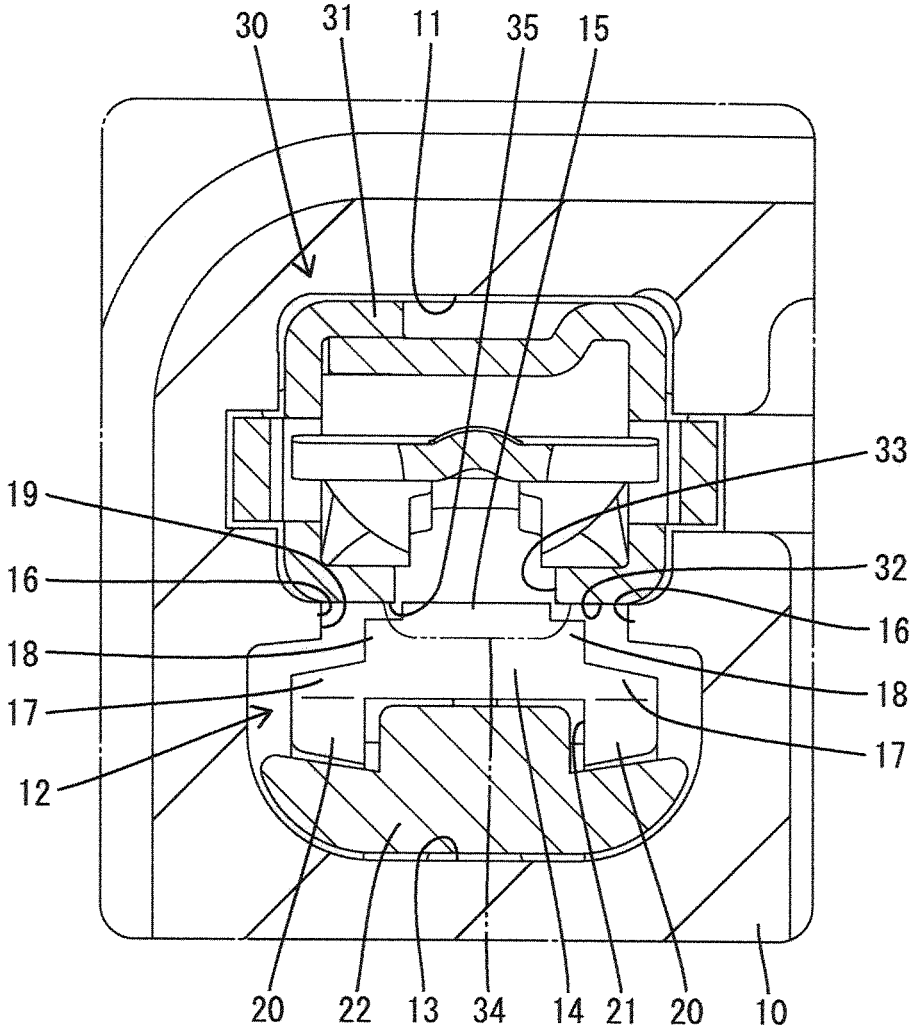
FIG. 9 is a front view in section showing a state where an inserted state of the terminal fitting is detected by a detecting member.

The locking lance 12 is formed unitarily with two reinforcing ribs 20 that project down toward the deformation space 13 along and from the opposite left and right sides of the main portion 14. The reinforcing ribs 20 extend in forward and backward directions along the entire length of the locking lance 12 from the front end to the rear end and increase the rigidity of the locking lance 12. Formation areas of the reinforcing ribs 20 in the width direction are the same as those of the first restrictions 17. Accordingly, the reinforcing ribs 20 and the first restrictions 17 are connected in the vertical resilient deforming direction of the locking lance 12. The reinforcing ribs 20 increase the rigidity of the first restrictions 17. As shown in FIG. 9, a detection space 21 is formed between the reinforcing ribs 20 for allowing the insertion of a detector 22. The detection space 21 directly communicates with the deformation space 13.

The locking protrusion 34 of the terminal fitting 30 contacts the locking projection 15 of the locking lance 12 while inserting the terminal fitting 30 into the terminal accommodating chamber 11, as shown in FIG. 4. As a result, the locking lance 12 is deformed resiliently to a releasing posture toward the deformation space 13. The locking protrusion 34 passes the locking projection 15 when the terminal fitting 30 reaches a proper insertion position. Thus, as shown in FIGS. 2 and 3, the locking lance 12 resiliently restores to a locking position to return to the free unbiased state. In this state, the locking projection 15 engages the locking protrusion 34 to retain the terminal fitting 30.

In this state, the upper surfaces of the first restrictions 17 are opposed to the lower surfaces of the receiving portions 16 from the side of the deformation space 13 with the first gap Sa formed therebetween, as shown in FIG. 6. Further, the upper surfaces of the second restrictions 18 are opposed to the receiving surfaces 35 of the terminal fitting 30 with the first clearance Sc formed therebetween and the second clearance Sd is formed between the upper surface of the rectangular tube 31 and the upper wall surface of the terminal accommodating chamber 11.

A backward pulling force may act on the terminal fitting 30 while the terminal fitting 30 is retained by the locking lance 12. In this situation, the locking protrusion 34 pushes the locking projection 15 back and the locking lance 12 may be deformed and warped so that the upper side becomes concave while the front end is displaced up toward the terminal accommodating chamber 11. However, the first restrictions 17 are connected to the reinforcing ribs 20 in a direction opposite to the terminal accommodating chamber 11 (toward the deformation space 13) in the vertical resilient deforming direction of the locking lance 12. The rigidity of the first restrictions 17 is high and, consequently, the first restrictions 17 increase the strength of the entire locking lance 12. Thus, the locking lance 12 is not likely to warp.

Figure 7:
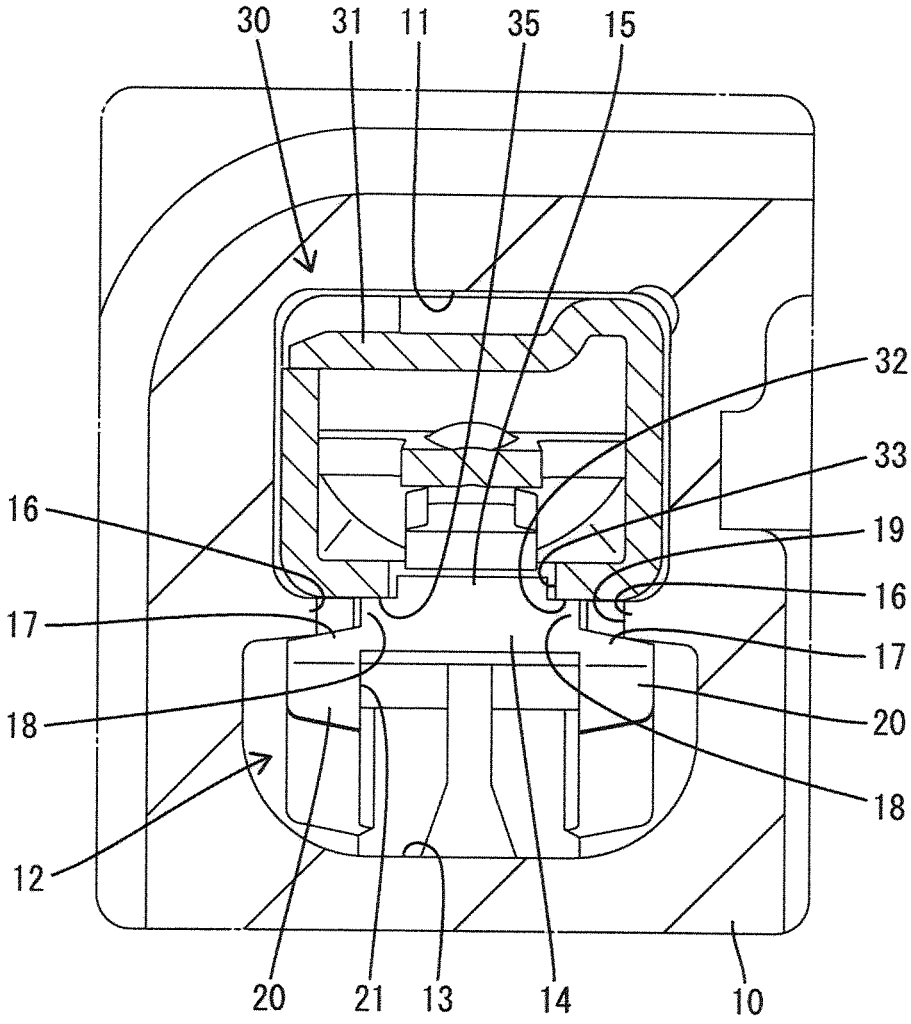
FIG. 7 is a front view in section showing a state where the warping of the locking lance is restricted by first restricting portions and receiving portions.

A strong pulling force on the terminal fitting 30 conceivably could warp the locking lance 12. However, the first restrictions 17 displace up during such warping and contact the receiving ribs 16 from below, as shown in FIG. 7. Thus, further upward displacement of the first restrictions 17 is prevented, thereby restricting warping of the locking lance 12. When the first restrictions 17 contact the receiving ribs 16, the upper surfaces of the second restrictions 18 contact the receiving surfaces 35 of the terminal fitting 30 or slightly push the rectangular tube 31 up after contacting the receiving surfaces 35 or are opposed to the receiving surfaces 35 with a small clearance formed therebetween.

Figure 8:
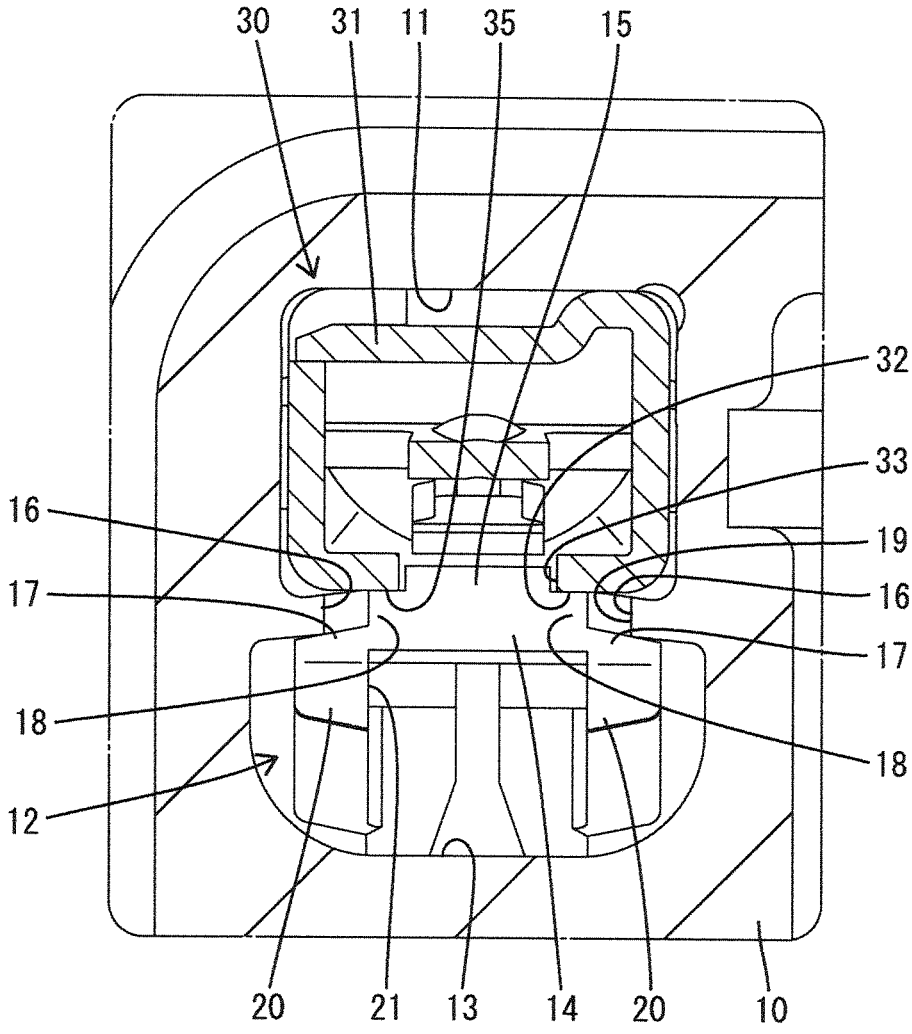
FIG. 8 is a front view in section showing a state where the warping of the locking lance is restricted by second restricting portions.

The backward pulling force on the terminal fitting 30 may increase in the state where the warping of the locking lance 12 is restricted by the first restrictions 17 and the receiving ribs 16. Thus, the first restrictions 17 may exert a push-up force sufficiently to deform the receiving ribs 16 toward the terminal accommodating chamber 11 so that the locking lance 12 is deformed more. As the locking lance 12 is deformed more, the first and second restrictions 17 and 18 displace up together to push the receiving surfaces 35 of the terminal fitting 30 and push up the rectangular tube 31. The upper surface of the rectangular tube 31 contacts the upper surface of the terminal accommodating chamber 11, as shown in FIG. 8, if the deformation of the locking lance 12 increases slightly. Thus, further upward displacement of the rectangular tube 31 is prevented and upward displacements of the second restrictions 18 held in contact with the rectangular tube 31 from below also are prevented. Accordingly, further upward displacement and warping of the locking lance 12 are prevented reliably.

The housing 10 has the receiving ribs 16 located at the opposite sides of the locking lance 12 in the width direction, which intersects the resilient deforming direction of the locking lance 12. Further, the first restrictions 17 are formed unitarily on the opposite left and right outer side surfaces of the locking lance 12 in the width direction and are located at the side of the receiving portions 16 opposite the terminal accommodating chamber 11 in the resilient deforming direction of the locking lance 12. The first restrictions 17 are not in contact with the receiving portions 16 when the locking lance 12 is not deformed. Furthermore, the second restrictions 18 are formed unitarily on the opposite left and right outer side surfaces of the locking lance 12 and are opposed to the bottom surface 32 that has the locking hole 33. The second restrictions 18 are not in contact with the bottom surface 32 when the locking lance 12 is not resiliently deformed.

According to this configuration, if the terminal fitting 30 is pulled backward in the retained state where the locking projection 15 and the locking hole 34 are engaged and the locking lance 12 is warped while being displaced toward the terminal accommodating chamber 11, the first restrictions 17 engage the receiving ribs 16 and the second restrictions 18 engage with the bottom surface 32 (receiving surfaces 35) of the terminal fitting 30 to prevent any further warping of the locking lance 12. Thus, a reduction in the retaining function due to the warping of the locking lance 12 can be prevented by the first and second restrictions 17, 18.

Further, the first and second restrictions 17, 18 are connected in a stepwise manner on the opposite left and right outer side surfaces of the locking lance 12. That is, the thickness of the second restrictions 18 in the resilient deforming direction of the locking lance 12 is a dimension from the lower surfaces of the first restrictions 17 to the upper surfaces of the second restrictions 18. Thus, a larger thickness of the second restrictions 18 can be secured as compared with the case where second restrictions laterally project in the width direction from positions above first restrictions (case where the first and second restricting portions are in the form of projections independent of each other). Therefore, the rigidity of the second restrictions 18 is high.

The front end of the locking lance 12 is displaced most when the locking lance 12 is warped. As a result, the engaged positions of the first restrictions 17 with the receiving ribs 16 and those of the second restrictions 18 with the open outer surface are both set on the front part of the locking lance 12. In this way, warping of the locking lance 12 is suppressed.

The formation area of the reinforcing ribs 20 in forward and backward directions (extending direction of the locking lance 12) is continuous from the front end to the rear end of the locking lance 12. Thus, the locking lance 12 is reinforced over the entire length thereof to prevent the locking lance 12 from warping. Further, the reinforcing portions 20 are arranged along the opposite sides in the width direction intersecting the resilient deforming direction of the locking lance 12. Therefore, the rigidity of the locking lance 12 is higher as compared with the case where a reinforcing portion is provided only at one position in a widthwise central part.

The detector 22 is inserted into the deformation space 13 and the detection space 21 from before the housing 10, as shown in FIG. 9, to detect whether the terminal fitting 30 is inserted properly into the terminal accommodating chamber 11. The detector 22 can be inserted into the deformation space 13 and the detection space 21 without being interfered with by the locking lance 12 if the terminal fitting 30 is inserted properly. However, the locking protrusion 34 of the terminal fitting 30 pushes the locking lance 12 down into the deformation space 13 if the terminal fitting 30 is inserted insufficiently. Thus, the detector 22 interferes with the locking lance 12 and cannot be inserted deep into the deformation space 13 and the detection space 21.

The two laterally spaced reinforcing ribs 20 project toward the deformation space 13 and extend in forward and backward directions along a range at least including the locking lance 12, as shown in FIG. 9. Accordingly, the reinforcing ribs 20 guide the detector 22 into the deformation space 13 from the front without shaking thereby smoothing a detecting operation by the detector 22.

Figure 10:
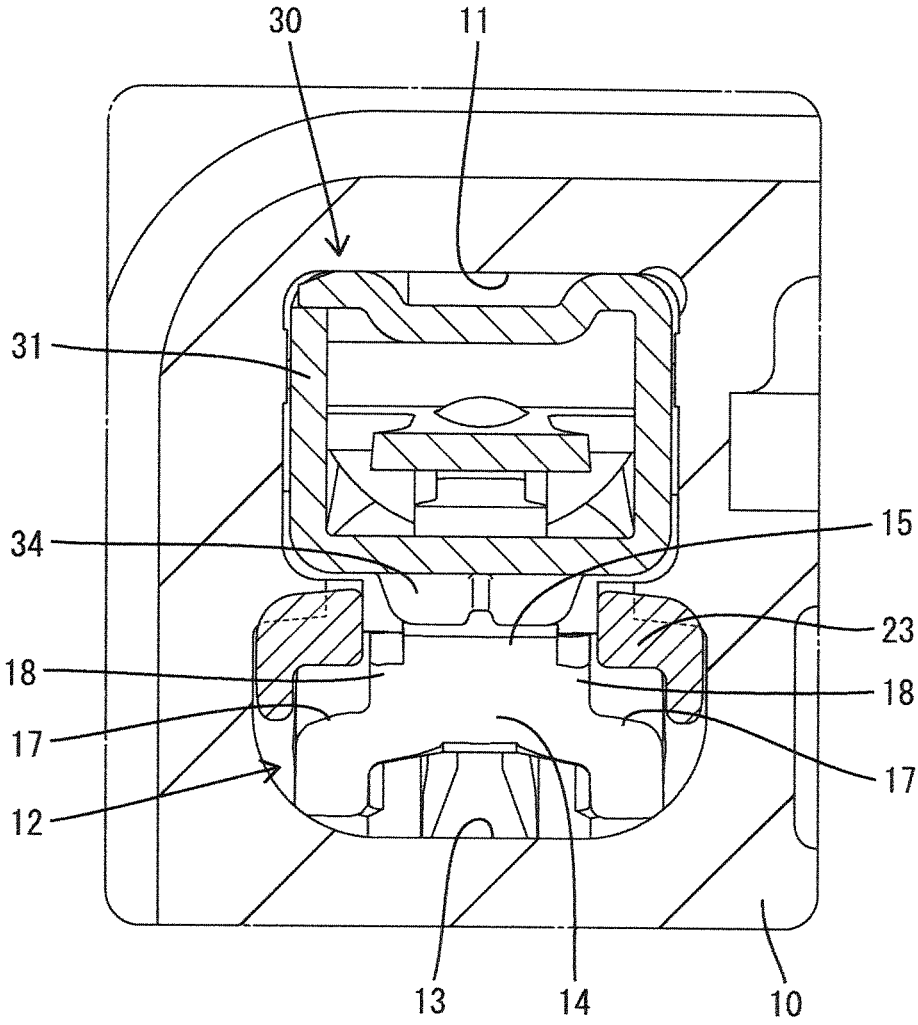
FIG. 10 is a front view in section showing a state where the terminal fitting is released from a retained state by the locking lance by a jig.
Figure 11:
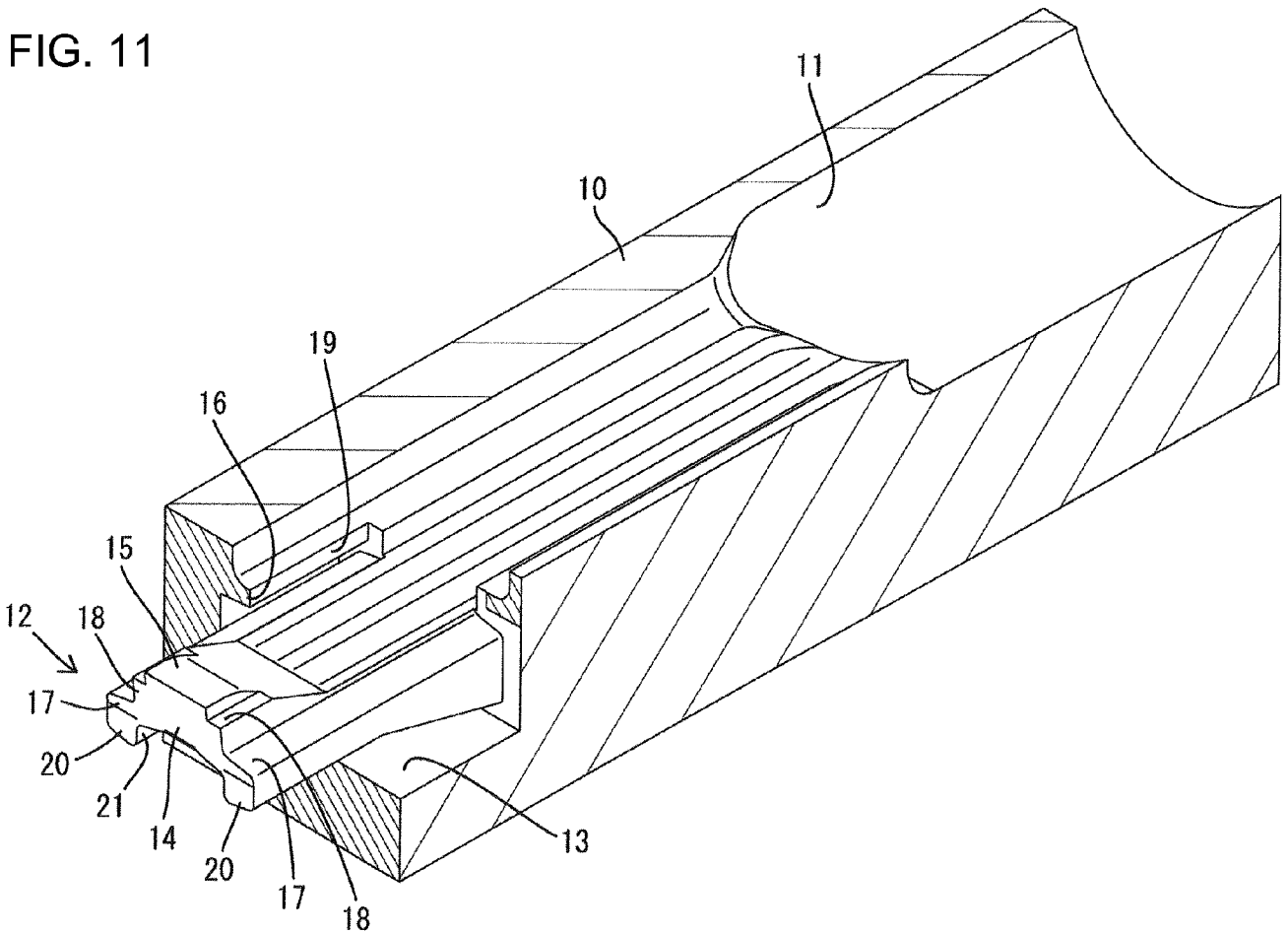
FIG. 11 is a perspective view, partly cut away, showing the shape of the locking lance.

A forked jig 23 is inserted into the housing 10 from the front and placed on the upper surfaces of the first restrictions 17 to push the locking lance 12 down toward the deformation space 13, as shown in FIG. 10, so that the terminal fitting 30 can be withdrawn from the terminal accommodating chamber 11. The locking projection 15 is disengaged from the locking protrusion 34 and the terminal fitting 30 is released from the retained state by the locking lance 12 so that the terminal fitting 30 may be withdrawn backward thereafter.

The present invention is not limited to the above described embodiment. For example, the following embodiments also are included in the scope of the invention.

Although the reinforcing ribs are continuous from the front end to the rear end of the locking lance in the above embodiment, the formation area of the reinforcing ribs in forward and backward directions may be shorter than the entire length of the locking lance.

Two reinforcing ribs are provided along the opposite widthwise sides of the locking lance. However, two reinforcing ribs may be provided at positions closer to the widthwise center than to the opposite widthwise side edges or one reinforcing rib may be provided at only one position in the widthwise center.

The engaged positions of the restrictions with the receiving ribs are set on the front end part of the locking lance in the above embodiment. However, these engaged positions may be set at center positions of the locking lance in forward and backward directions.

The restrictions are connected to the reinforcing ribs projecting in the direction opposite to the terminal accommodating chamber in the resilient deforming direction of the locking lance in the above embodiment. However, they may project independently of the reinforcing ribs.

What is claimed is:

1. A connector, comprising:

a housing (10) made of synthetic resin and formed with a terminal accommodating chamber (11);

a locking lance (12) cantilevered forward along an inner wall surface of the terminal accommodating chamber (11) and resiliently deformable in directions toward and away from the terminal accommodating chamber (11);

a locking projection (15) integrally formed on the locking lance (12) and projecting toward the terminal accommodating chamber (11);

a terminal fitting (30) to be inserted into the terminal accommodating chamber (11) from behind;

a locking hole (34) formed in the terminal fitting (30) and configured to retain the terminal fitting by being engaged with the locking projection (15) when the terminal fitting (30) is inserted in the terminal accommodating chamber b(11); and at least one reinforcing rib (20) integrally formed on the locking lance (12) and projecting in a direction opposite to the terminal accommodating chamber (11) in a resilient deforming direction of the locking lance (12).

2. The connector of claim 1, wherein a formation area of the reinforcing rib (20) in forward and backward directions is continuous from a front end to the rear end of the locking lance (12).

3. The connector of claim 1, wherein the at least one reinforcing rib (20) comprises two reinforcing ribs (20 arranged along opposite sides spaced apart in a width direction intersecting with the resilient deforming direction of the locking lance (12).

4. The connector of claim 3, further comprising:

two receiving ribs (16) formed in the housing and located at opposite sides of the locking lance (12) in the width direction intersecting with the resilient deforming direction of the locking lance (12); and two restrictions (17) integrally formed on opposite widthwise outer side surfaces of the locking lance (12) at sides of the receiving ribs (16) opposite the terminal accommodating chamber (11) in the resilient deforming direction of the locking lance (12);

wherein the restrictions (17) are connected to the reinforcing ribs (20).

5. The connector of claim 1, wherein:

the housing (10) is formed with a deformation space (13) that permits the locking lance (12) to be deformed away from the terminal accommodating chamber (11) while inserting the terminal fitting (30) and is open at front end surface of the housing (10);

a detector (22) for detecting an inserted state of the terminal fitting (30) is inserted into the deformation space (13) from the front;

the at least one reinforcing rib comprising two reinforcing ribs (20) projecting toward the deformation space (13) and spaced apart in a width direction intersecting the resilient deforming direction of the locking lance (12).

6. The connector of claim 5, wherein a formation area of the reinforcing ribs (20) in forward and backward directions is a range at least including a front end part of the locking lance (12).

* * * * *